United States Patent [19]

Kampert

[11] 4,060,462

[45] Nov. 29, 1977

[54] COLOR ANODIZING OF ALUMINUM

[75] Inventor: William P. Kampert, Lower Burrell, Pa.

[73] Assignee: Aluminum Company of America, Pittsburgh, Pa.

[21] Appl. No.: 734,613

[22] Filed: Oct. 21, 1976

[51] Int. Cl.[2] ..... C25D 11/14

[52] U.S. Cl. ..... 204/58

[58] Field of Search ..... 204/58

[56] References Cited

U.S. PATENT DOCUMENTS

| | | | |
|---|---|---|---|
| 3,227,639 | 1/1966 | Kampert | 204/58 |
| 3,935,084 | 1/1976 | Terai et al. | 204/58 |

OTHER PUBLICATIONS

"The Surface Treatment & Finishing of Al", by S. Wernick et al., 3rd Ed., 1964, pp. 298–303, 306.

*Primary Examiner*—R. L. Andrews

*Attorney, Agent, or Firm*—Andrew Alexander

[57] ABSTRACT

A process for producing a colored coating on aluminum comprises anodizing the aluminum at a voltage in the range of 6 to 24 volts in a sulfuric acid electrolyte and thereafter reducing the voltage to not greater than 3 volts while further anodizing the aluminum in the aforementioned electrolyte thereby producing the colored coating.

8 Claims, 4 Drawing Figures

COLOR ANODIZING OF ALUMINUM

INTRODUCTION

This invention relates to anodizing aluminum and more particularly it relates to producing colored anodic coatings on aluminum.

In the prior art, various methods have been used to obtain colored anodic coatings on aluminum. These methods include dyeing an otherwise colorless anodic coating or anodizing in a special electrolyte, e.g. combination sulfuric/sulfophthalic acid, to produce an integral colored coating. It is also known in the prior art that colored anodic coatings can be produced on aluminum using sulfuric acid. For example, Terai et al. U.S. Pat. No. 3,935,084 disclose that colored oxide films can be formed on aluminum by anodizing in sulfuric acid using D.C. voltage followed by an A.C. voltage treatment, the voltage of which is lower than the D.C. voltage. However, in this process to increase the degree of coloring in the oxide film, the A.C. voltage has to be raised and lowered in a voltage range lower than the D.C. voltage.

Quite surprisingly, I have discovered a process for producing colored anodic coatings on aluminum which employs controlled D.C. voltages and a sulfuric acid type electrolyte.

SUMMARY OF THE INVENTION

An object of this invention is to produce a colored anodic coating on aluminum.

Another object of this invention is to produce a colored anodic coating on aluminum by using controlled D.C. anodizing voltages.

In accordance with these objectives, a process for producing colored anodic coatings on aluminum comprises anodizing the aluminum at a voltage in the range of 6 to 24 volts in a sulfuric acid electrolyte and thereafter reducing the voltage to not greater than 3 volts while further anodizing the aluminum to produce the colored coating.

DETAILED DESCRIPTION OF THE PREFERRED EMBODIMENTS OF THE INVENTION

Figure 1:
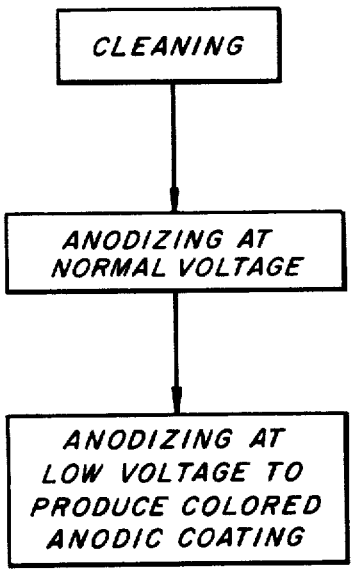
FIG. 1 is a flow chart illustrating a method for producing a colored anodic coating in accordance with the invention.

In FIG. 1, there is provided a schematic for producing a colored anodic coating on aluminum. In the first step, the aluminum material to be treated in accordance with the invention is subjected to a cleaning pretreatment well known to those skilled in the art which includes deoxidizing, caustic etching and desmutting. Thereafter, the aluminum material, which can be sheet or extrusion or other product, is subjected to a conventional anodizing treatment using D.C. voltage and a sulfuric acid electrolyte, for example, as taught by Gower U.S. Pat. No. 1,869,058. Having thus provided an anodic coating as described, in accordance with the present invention, a controlled color is obtained therein by reducing the voltage to a fraction of the original anodizing voltage and by continuing the anodization process for a short period of time thereafter. It should be noted that while reducing the voltage, the anodization treatment should be continued. That is, the passage of current should be continued while the reduction of voltage is taking place. If the anodization process is allowed to stop while reducing the voltage, color can fail to develop or if it does develop, often it is non-uniform.

The reduced voltage can be in a range of 0.5 to 3 volts, with a preferred voltage being in the range of about 1 to 2.5 volts. Treatments at higher than 3 volts normally results in lack of color development in the anodic coating and at lower than 0.5 volt the color development can require an unduly long anodizing period. It should be noted that the reduced voltage referred to should normally be measured at or relatively close to the anodizing surface to minimize the effect of the electrolyte and the like.

Figure 2:
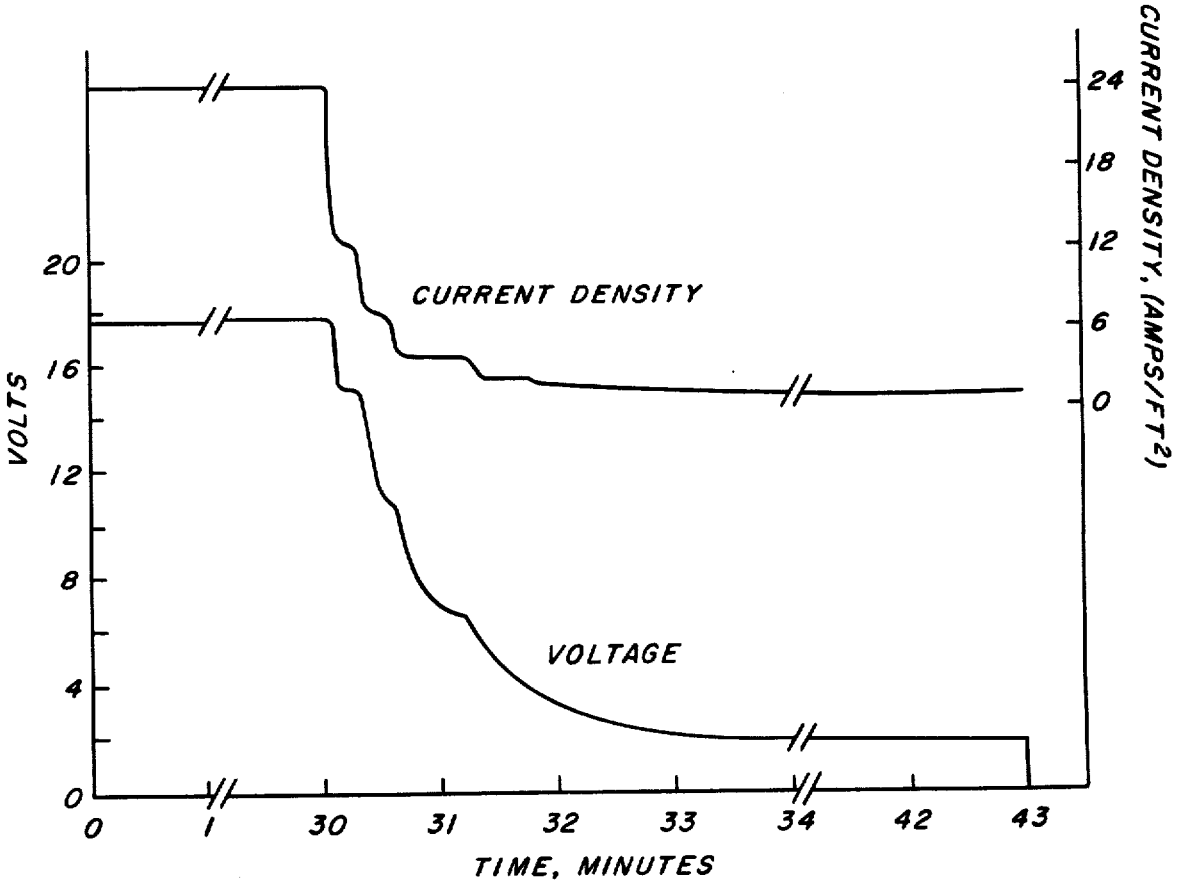
FIG. 2 is a chart illustrating typical voltage and current density curves resulting from the process of the invention.

With respect to the original anodizing voltage referred to, by anodizing in a sulfuric acid electrolyte, this voltage can range from 6 to 24 volts. For purposes of the present invention, preferably this voltage should be regulated between 12 and 20 volts. For example, with reference to FIG. 2, it will be seen that a starting voltage of 18 volts is used to produce a conventional coating having a thickness of about 1 mil. Also, by reference to FIG. 2 it will be observed that a reduced voltage of about 2 volts can be used to impart a controlled color to what would otherwise be regarded as a substantially colorless coating. The time period employed to reduce the original anodizing voltage to the color developing voltage can be relatively short with a preferred time period being in the range of 0.5 to 5 minutes. FIG. 2 indicates that a time period of 3 minutes to reduce the voltage is quite suitable. It is preferred that the voltage be reduced from the original voltage to the color developing voltage without interruption of the anodizing process, substantially in a manner similar to that shown in FIG. 2. The voltage can be reduced in steps as shown in FIG. 2 or it can be reduced gradually to the lower voltage. The preferred rate of reduction is a rate in the range of 1 to 16 volts/minute with a typical voltage reduction rate being about 4 volts/minute.

The length of time from the start of the reduction of the voltage to the end of the color producing step can be as much as half the higher voltage anodizing period. For example, if the higher anodizing period is 30 minutes, the color anodizing or lower voltage period can be as much as 15 minutes. In certain instances, though, the color anodizing step may require only a few minutes. Typically, the color anodizing step requires a time period in the range of 4 to 12 minutes.

Figure 3:
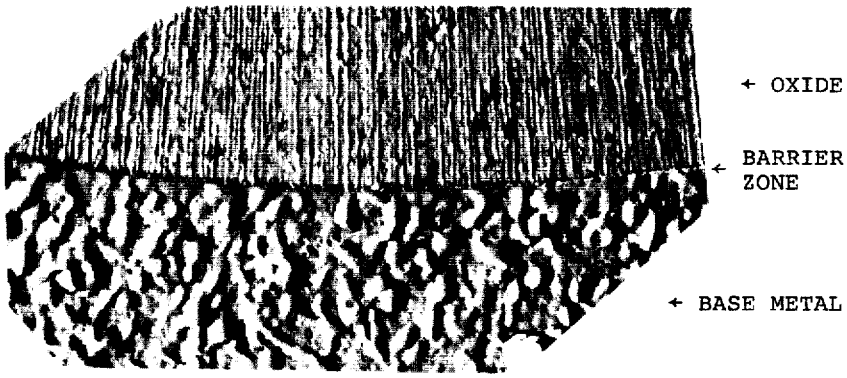
FIG. 3 shows a cross section of a conventional sulfuric acid anodized coating at 20,000 magnification.
Figure 4:
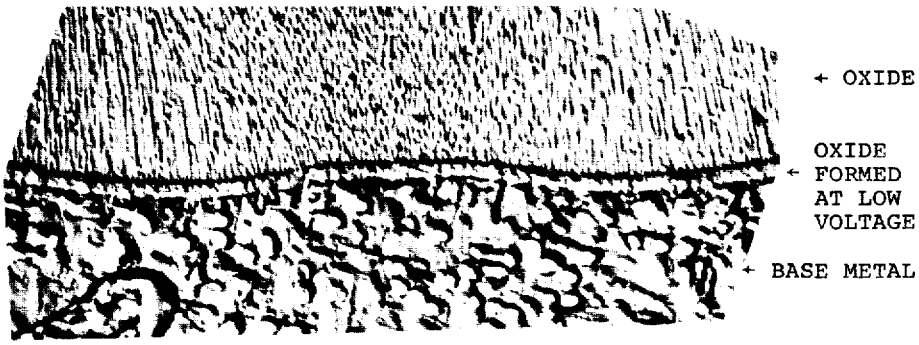
FIG. 4 shows a cross section at 20,000 magnification of a sulfuric acid anodized coating including an oxide layer formed at low voltage in accordance with the invention.

The reduced voltage anodizing treatment increases the thickness of an oxide layer, sometimes referred to as a barrier zone, located intermediate the oxide coating and the aluminum substrate metal. The barrier zone which is typical of that obtained by conventional sulfuric acid anodizing of aluminum is shown in FIG. 3. Referring now to FIG. 4, it will be seen that the barrier zone or oxide layer has been increased rather significantly by anodization treatments in accordance with the present invention. It is the increase in thickness together with composition of the second oxide layer provided at low voltage which is believed to provide color in an oxide coating which otherwise, for all practical purposes, would be a clear or colorless coating. These oxide coatings were produced in 15 wt.% sulfuric acid as described in Example 1.

With respect to the sulfuric acid anodizing electrolyte, its concentration should be in the range of 7 to 35 wt.%. Higher concentrations are undesirable since they can affect the integrity of the coating. A preferred concentration of sulfuric acid is in the range of 12 to 18 wt.%, the remainder water.

The temperature of the electrolytic bath throughout the anodizing process can be kept at or near room temperature. However, in certain instances the temperature may be raised as high as 95° F depending to a certain extent on the color desired. A suitable electrolyte temperature is in the range of 60° to 95° F. It should be noted that temperature can influence the color development. For example, in certain instances as the temperature is increased there is a tendency for the coating to darken. That is, aluminum alloys which would produce a light bronze color in an electrolyte at or near room temperature can produce darker colors as the temperature is raised.

While the inventor does not necessarily wish to be held to any theory of invention, it is believed that the color development obtained by the low voltage anodizing step results from a thin oxide layer formation intermediate the conventional oxide layer and the aluminum substrate. It is believed that this thin oxide layer operates to provide color by entrapment of alloying constituents or precipitates, e.g. $Mg_2Si$ in 6000 series aluminum alloy (Aluminum Association designation), in the thin oxide layer. By entrapment of alloy constituents or precipitates it is meant that such material is not dissolved in the anodizing electrolyte as appears to be the case at normal or higher voltage anodizing conditions.

The present invention contemplates within its purview any alloy which responds by developing color under this reduced voltage technique. However, aluminum alloys preferred include those referred to as the aluminum-magnesium-silicon alloys. Examples of such alloys under the Aluminum Association Alloys designation are 6061, 6063, 6463, 6351 and 6262. The temper of these alloys is important and the preferred temper is that known as T52. The T52 temper condition can be obtained by artificially aging an aluminum alloy which has been provided in the T4 temper, the T4 temper indicating that the alloy has been solution heat treated, quenched and permitted to reach a stable condition. A typical artificial aging treatment which may be employed to obtain the T52 condition is a treatment at 460° F for about 2 hours. The T52 temper might also be referred to as an over aged condition.

The aluminum-magnesium-silicon alloys anodized in accordance with the present invention can produce colors ranging from light tan and bronze to light and medium grays.

Coatings produced in accordance with this invention may be sealed by conventional procedures. For example, the coating may be sealed in boiling water containing sealing salts such as nickel acetate and sealing smudge formed may be removed with an acid treatment without any adverse effects to the coating.

The following examples are further illustrative of the invention.

EXAMPLE 1

Specimens of Aluminum Association Alloy 6063 in the T52 temper condition were anodized in sulfuric acid for 30 minutes at a current density of 24 amperes/ft$^2$ which resulted in a starting voltage of 16 volts and an ending voltage of 17 volts. Thereafter, the voltage was reduced to 2 volts and the anodization process continued for 8 minutes. The sulfuric acid concentrations and temperatures are tabulated below. Also, the colors obtained are tabulated below. For comparison purposes three specimens of 6063 alloy were treated as above except for the following differences. A first specimen was anodized without using the 2 volt treatment. In the anodization treatment of a second specimen, the voltage was reduced from 17 volts to zero volts and then anodized at 2 volts for a period of 8 minutes. In the treatment of a third specimen, the voltage was reduced from 17 volts to 4 volts and the anodization process continued for 8 minutes. These three anodizing treatments produced a substantially clear or colorless anodic coating.

Table I

| $H_2SO_4$ Electrolyte | | |
|---|---|---|
| Concentration (wt. %) | Temperature | Color of Coating |
| 7 | 90° F | light gray |
| 15 | 75° F | light bronze |
| 15 | 85° F | light gray |
| 25 | 75° F | light bronze |
| 25 | 90° F | medium gray |
| 35 | 75° F | light bronze |

EXAMPLE 2

Specimens of Aluminum Association Alloy 6463 in the T52 temper were anodized as in Example 1 in an electrolyte containing 15 wt.% $H_2SO_4$. The temperatures of the electrolyte used in this instance was 75° F and 85° F. The 75° F treatment resulted in a light metallic bronze color and the 85° F treatment resulted in a medium metallic bronze color.

Thus, it can be seen from these examples that colored anodic coatings are obtained on aluminum using controlled D.C. voltages and an electrolyte which would normally produce a clear or substantially colorless coating. It will also be observed that the colors can be varied by varying the temperature and concentration of the electrolyte.

While the invention has been described in terms of preferred embodiments, the claims appended hereto are intended to encompass other embodiments which fall within the spirit of the invention.

Having thus described the invention and certain embodiments thereof, I claim:

1. A process capable of producing a colored anodic coating on an aluminum alloy substrate comprising:
   a. anodizing said aluminum in a sulfuric acid electrolyte at a direct current voltage in the range of 6 to 24 volts to provide a conventional, substantially colorless coating thereon;
   b. thereafter, reducing the voltage to a direct current voltage in the range of 0.5 to 3 volts while continuing to anodize said aluminum in the electrolyte; and
   c. anodizing said aluminum alloy substrate at said voltage in the range of 0.5 to 3 volts for a period of time not greater than 15 minutes to produce the colored anodic coating by increasing the thickness of a barrier zone located intermediate the conventional coating and the aluminum alloy substrate.

2. The process of claim 1 wherein in the first step thereof the voltage employed is in the range of 12 to 20 volts.

3. The process of claim 1 wherein in the second step thereof, the voltage employed is in a range of 1 to 2.5 volts.

4. The process of claim 1 wherein the aluminum alloy employed is an aluminum-magnesium-silicon alloy.

5. The process according to claim 4 wherein the alloy is provided in a T52 temper.

6. The process according to claim 1 wherein the electrolyte has a temperature in the range of 60° to 95° F.

7. The process according to claim 1 wherein the alloy employed is aluminum alloy 6063.

8. A process capable of producing a colored anodic coating on aluminum alloy substrate, the process comprising:

a. providing an aluminum-magnesium-silicon alloy substrate in a T52 temper;

b. anodizing the aluminum substrate in a solution containing 12 to 18 wt.% sulfuric acid, the remainder essentially water, said anodizing being performed at a direct current voltage in the range of 12 to 20 volts and a temperature in the range of 60° to 95° F to provide a conventional, substantially colorless coating thereon;

c. thereafter, reducing said voltage to a direct current voltage in the range of 1 to 2.5 volts while continuing to anodize said aluminum alloy substrate; and d. anodizing said aluminum article at said voltage in the range of 1 to 2.5 volts for a period in the range of 4 to 12 minutes to produce the colored anodic coating by increasing the thickness of a barrier zone located intermediate the conventional coating and the aluminum alloy substrate.

* * * * *